United States Patent [19]

Tosches

[11] 4,259,997

[45] Apr. 7, 1981

[54] WEFT CARRIER

[75] Inventor: Anthony J. Tosches, Greensboro, N.C.

[73] Assignee: Rockwell International Corporation, Pittsburgh, Pa.

[21] Appl. No.: 91,930

[22] Filed: Nov. 7, 1979

[51] Int. Cl.[3] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 2,567,993 | 9/1951 | Dewas | 139/448 |
| 3,978,897 | 9/1976 | Tosches | 139/448 |
| 4,062,382 | 12/1977 | Rohr et al. | 139/448 |

*Primary Examiner*—Henry Jaudon

[57] ABSTRACT

An improved weft yarn insertion carrier made entirely of non-cast components which includes an elongated main body made up of horizontal and vertical webs, flexible gripper means attached to the vertical web of the main body and means for adjusting the gripping pressure exerted between the flexible gripper and the main body portion.

3 Claims, 4 Drawing Figures

WEFT CARRIER

BACKGROUND OF THE INVENTION

In shuttleless looms and more particularly in those looms in which weft yarn is supplied from a stationary source located outside of the lateral limits of the warp yarns, it is customary to insert each pick of weft by means of a reciprocating carrier or carriers which are mounted on inserters. In a common type of shuttleless operation, a supply of weft is located adjacent the right hand side of the loom and each pick is drawn from the source and inserted into the shed formed between the warp yarns. Insertion is initiated by means of an inserter on the right hand side of the loom, this inserting carrier moving the yarn to approximately the midpoint between the two sides of the loom. At the time the end of the weft yarn arrives at the middle of the warp shed, a carrier mounted on an inserter located on the left hand side of the loom grips the end of the yarn and pulls it the remainder of the distance across the loom. This type of insertion is commonly referred to as the Dewas or gripper insertion system since the extending carrier actually grips or clamps the end of the yarn to be drawn through the warp shed.

When utilizing this system of weft yarn insertion, it is obvious that consistent and accurate transfer of the weft must be made between the inserting and extending carriers. In the past, a high degree of reliability has been accomplished by utilizing comparatively large, relatively heavy, cast inserters and while these inserters did perform reliably, they were expensive to manufacture and difficult to replace when replacement became necessary due to accident or wear.

It is a principle object of this invention to provide an improved extending carrier which is both simplier and cheaper to manufacture and which can be replaced expeditiously.

A further object of this invention is to provide an extending carrier which is produced solely from plastically deformed non-cast parts.

An additional object of this invention is to provide an improved extending carrier in which the gripping pressure between gripping elements can be readily adjusted.

Other object and advantages of this invention will be in part obvious and in part explained by reference to the accompanying specification and drawings in which.

DESCRIPTION OF THE INVENTION

Figure 1:
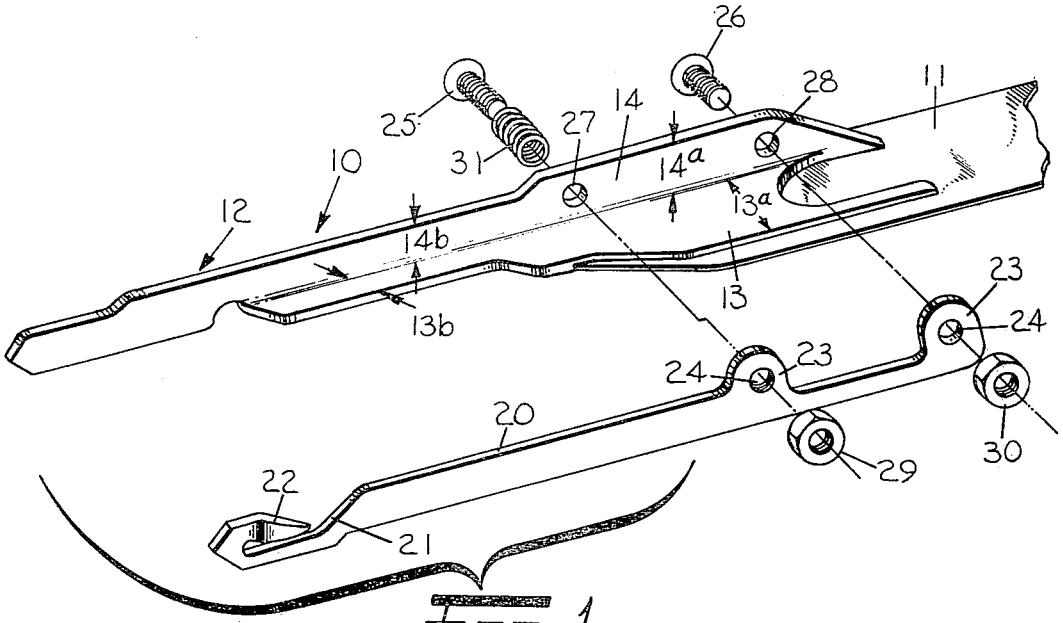
FIG. 1 is an exploded perspective view of a carrier constructed in accordance with this invention and attached to the end of an inserter.

For a better understanding of the invention, reference is made to the drawings and particularly to FIG. 1 wherein an improved extending carrier 10 is shown mounted on or connected to the end of a reciprocating inserter 11. In this case, inserter 11 is shown as a broad, flat, flexible, band-like element which can be wrapped around a tape wheel located on the side of the loom, in a manner which is well known in the industry. Obviously, the type of inserter which is used to move the carrier 10 into and from the warp shed is not important since any type of inserter, either flexible or rigid, that is known in the prior art would be equally effective.

The carrier 10 comprises a main body portion 12 which is made up of a flat horizontal web portion 13 and a vertical web portion 14 which extends upwardly from horizontal web 13. It will be seen that the horizontal web portion 13 has a relatively wider dimension **13*a* on the end which overlays inserter 11 and a relatively narrower dimension 13*b* which is located beyond the outer end of inserter 11. Similarly, the vertical web portion 14 which extends upwardly from web portion 13 has a relatively wider portion 14*a* which is adjacent horizontal web portion 13*a* and a relatively narrower vertical dimension 14*b* which is also located beyond the outer end of inserter 11 as is narrower dimension 13*b***.

Carrier 10 also includes flexible gripper means whereby yarn that has been inserted into the warp shed by the inserting carrier can be engaged and extended to the other side of the loom. This gripper means comprises an elongated flexible element 20 which on its outer or left hand end as viewed in FIG. 1 has means for directing and engaging the yarn. The yarn directing and engaging means includes a downwardly and outwardly yarn engaging surface 21 and an outwardly and rearwardly extending yarn hook 22. The flexible body or gripper means 20 has on its other end a pair of raised ears 23 which are provided with internally threaded holes 24. The flexible gripper 20 is secured to the vertically extending web 14 by means of threaded fasteners 25 and 26 each of which extends through the openings 27 and 28 located in web 14 for threadably engaging threads provided on the interior of holes 24. Each of the threaded fasteners 25 and 26 extends completely through holes 24 to engage the locking nuts 29 and 30 respectively. That is, when fasteners 25 and 26 are threaded through the openings 24, the nuts 29 and 30 will be threadably received on the portion which extends beyond the outer surface of member 20 so that fasteners 25 and 26 cannot loosen during operation. One final element which is provided is the biasing spring 31 that is located between the head of threaded fastener 25 and the outer surface of vertical web 14. The presence of this spring permits through adjustment of fastener 25 and nut 29 a change in the force that is necessary to separate the outer end of vertical web 14 from the outer end of the resilient gripping member 20.

Figure 2:
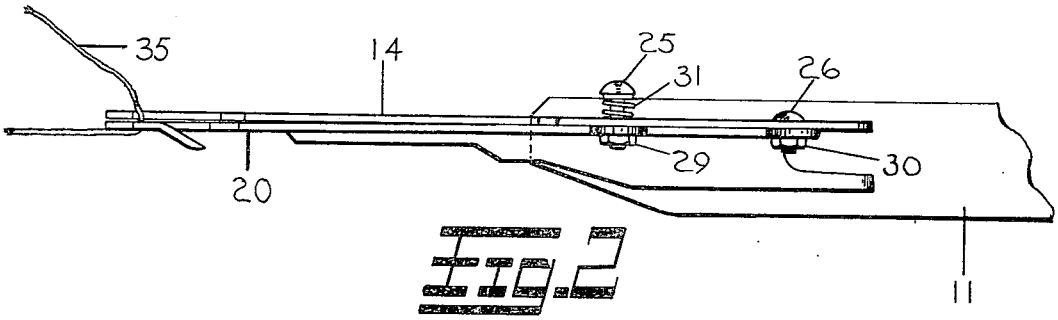
FIG. 2 is a top elevation of the inserter shown gripping a weft yarn.

In the vertical elevation shown in FIG. 2, the carrier is shown in its assembled position mounted on inserter 11 and showing a piece of yarn 35 being gripped between the cooperating inner surfaces of vertical web 14 and gripping member 20.

Figure 3:
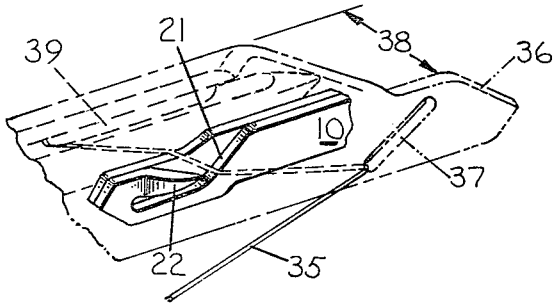
FIG. 3 is a fragmented perspective view of the end of the carrier of this invention and showing a phantom view of the inserting carrier as it presents the yarn to the extending carrier.
Figure 4:
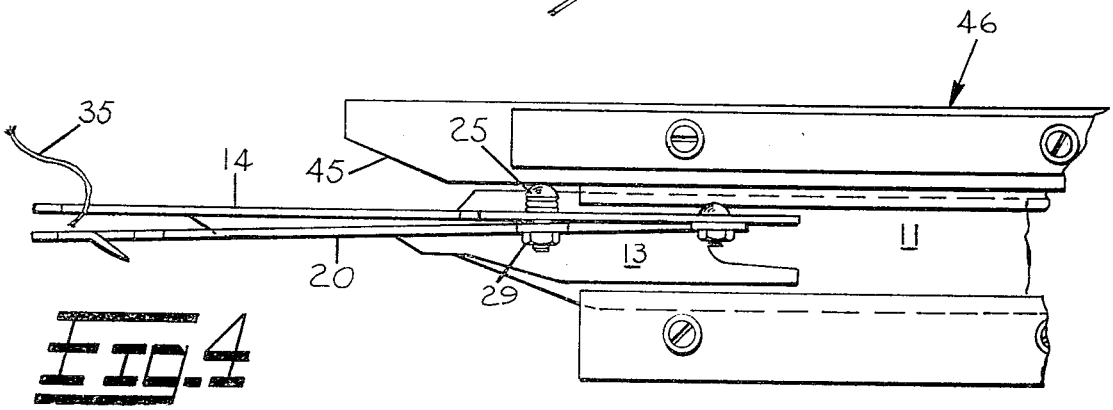
FIG. 4 is a top elevation showing the inserter and extending carrier removed to the left hand side of the loom where release of the end of the weft yarn is effected.

In operation, yarn is withdrawn from a yarn package located outside of the lateral limits of the warp by means of an inserter carrier. In FIG. 3 there is shown in phantom an inserter carrier 36 in which yarn 35 extends from the slot 37 across the width of carrier 36 (indicated by numeral 38) and then out the generally horizontal slot 39 which is located on the back wall of the inserter carrier. When inserter carrier 36 reaches the midpoint of the loom, carrier 10 has moved into carrier 36 as indicated in FIG. 3. It can be seen that the outer end of the extending carrier has moved beyond the horizontal length of yarn located between slots 37 and 39 so that the yarn has come into contact with the yarn engaging surface 21. After the carrier has overlapped to this extent, reverse movement is effected so that the yarn 35 is moved outwardly and downwardly along surface 21 and is directed in toward the contacting surfaces of vertical web 14 and gripper 20 by means of yarn hook 22. Continued movement of gripper 10 toward the left hand edge of the warp continues until, referring to FIG. 4, the head of threaded fastener 25 contacts cam surface 45 of the inserter guide 46. When threaded fastener 25 moves down cam surface 45, it will cause the resilient gripper 20 to be moved away from vertical web portion 14 and thereby release the end of yarn 35.

It will be noted that the extending carrier 10 is constructed entirely of components that have been plastically deformed to achieve the desired configuration. That is, the carrier can be constructed entirely of sheet metal parts that are simply deformed to the desired shapes. This is a significant difference from carriers known in the prior art since previous construction has been effected by casting and then machining to final configuration. This carrier is simple and the gripping pressure can be readily adjusted to accommodate its applicability to use in configuration with a variety of yarns.

Although the present invention has been described in connection with a preferred embodiment, it should be understood that modifications and variations may be resorted to without departing from the spirit and scope of the invention as those skilled in the art will readily understand. Such modifications and variations are considered to be within the purview and scope of the appended claims.

I claim:

1. An improved carrier for inserting weft yarn into the shed formed between warp yarns on a loom of the type in which the weft yarn is supplied from a source located outside of the warp and is inserted into the shed by carriers attached to reciprocating inserters, said improved carrier comprising:

(a) an elongated main body portion including:
  (i) a flat horizontal web portion having a relatively wider dimension for uniting the inserter and a relatively narrower dimension which is located beyond the outer end of the inserter; and
  (ii) a vertical web portion which extends upwardly from said horizontal web and has a relatively wider dimension on that end adjacent the relatively wider dimension of said horizontal web and has a relatively narrower dimension located beyond the outer end of the inserter;

(b) flexible gripper means having yarn directing and engaging means formed on one end thereof;

(c) means fixedly securing the end of said gripper means opposite the end with said yarn directing and engaging means to the relatively wider portion of said vertical web; and (d) means connecting said vertical web to said gripper means between the ends thereof to adjust the gripping pressure between said vertical web and said gripper means.

2. An improved carrier as defined in claim 1 wherein said yarn directing and engaging means comprises means defining a downwardly and outwardly directed yarn guiding surface and an outwardly and rearwardly extending yarn book.

3. An improved carrier as defined in claim 1 wherein said pressure adjusting means comprises a threaded fastener and spring biasing means.

* * * * *